United States Patent [19]

Pringle

[11] 4,248,308

[45] Feb. 3, 1981

[54] EXTERNALLY ADJUSTED SPRING ACTUATED WELL VALVE

[75] Inventor: Ronald E. Pringle, Houston, Tex.

[73] Assignee: Camco, Incorporated, Houston, Tex.

[21] Appl. No.: 33,596

[22] Filed: Apr. 27, 1979

[51] Int. Cl.[3] ..... F04F 1/08; E21B 43/12

[52] U.S. Cl. ..... 166/322; 137/505.25; 137/524

[58] Field of Search ..... 166/319, 320, 321, 322; 175/302; 137/522, 523, 524, 505.25, 155

[56] References Cited

U.S. PATENT DOCUMENTS

| | | | |
|---|---|---|---|
| 2,059,540 | 11/1936 | Sephan | 175/302 |
| 3,255,774 | 6/1966 | Gallagher et al. | 137/524 |
| 3,298,392 | 1/1967 | Wilcox | 137/505.25 |
| 3,782,461 | 1/1974 | Watkins | 166/72 |
| 3,830,296 | 8/1974 | Shirley | 166/321 |
| 4,067,350 | 1/1978 | Raggio | 137/155 |

*Primary Examiner*—James A. Leppink
*Attorney, Agent, or Firm*—Fulbright & Jaworski

[57] ABSTRACT

In a well valve such as a safety valve or gas lift valve for controlling the fluid flow through a well tubing having a valve closure member with means for moving the valve member in a direction to open the valve and spring means acting against the opening force for moving the valve to a closed position, the improvement of an external adjustment for adjusting the spring closing force. A shoulder member is longitudinally movable in the housing but non-rotatably movable relative to the housing and abuts the spring. Adjusting means is rotatably connected, but is longitudinally fixed, relative to the housing and is exposed to the exterior of the housing for allowing external rotation of the adjusting means. Coacting threads between the shoulder means and the adjusting means moves the shoulder toward and away from the spring by externally rotating the adjusting means thereby varying the closing force of the spring.

3 Claims, 9 Drawing Figures

EXTERNALLY ADJUSTED SPRING ACTUATED WELL VALVE

BACKGROUND OF THE INVENTION

It is old to utilize various types of well valves such as a safety valve shown in U.S. Pat. No. 3,782,461 or a gas lift valve shown in U.S. Pat. No. 3,760,832 which are moved to an open position by a first surface controlled force and are moved to a closed position by a spring. The spring closing force is adjusted at the factory during assembly by making internal adjustments, such as selection of a suitable spring, to adjust the closing force of the valve and consequently its opening force in view of its intended specific application. However, in the event that the opening and closing force specifications for a particular application change, the valve is returned to the factory, partially disassembled, and readjusted for use under the specified operating conditions.

The present invention is directed to a well valve in which a spring actuated closing force can readily be adjustable from the outside of the valve without dismantling the valve whereby adjustments may be made quickly and accurately in the field as well conditions change thereby avoiding the necessity of shipping the valve to the factory for disassembly and readjustment.

SUMMARY

The present invention relates to the improvement in a well valve for controlling fluid flow through a well tubing in which the valve includes a housing and a valve closure member therein movable between open and closed positions with means for moving the valve member in a direction to open the valve, and spring means acting against the opening force for moving the valve to the closed position by providing an external adjustment for changing the spring closing force. The improvement includes shoulder means in the housing abutting the spring means with adjusting means for adjusting the shoulder means extending outside of the housing for moving the shoulder means towards and away from the spring means for varying the closing force of the spring means.

Another object of the present invention is the provision of shoulder means abutting the spring means which is longitudinally movable in the housing but non-rotatably movable relative to the housing.

Still a further object of the present invention is the provision of adjusting means which is rotatably connected but longitudinally fixed relative to the housing.

Still a further object is the provision of coacting thread means between the shoulder means and the adjusting means whereby external rotation of the adjusting means moves the shoulder means towards and away from the spring means for varying the closing force of the spring means.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENTS

Figure 1:
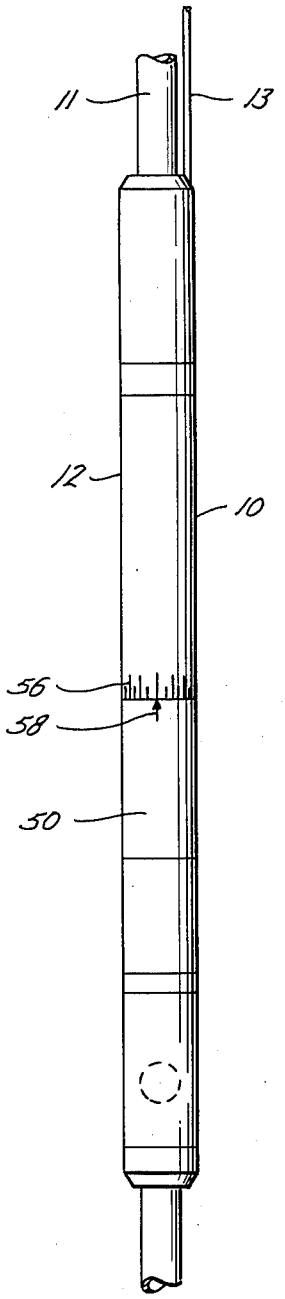
FIG. 1 is an elevational view of the present invention as used in a well safety valve.
Figure 3:
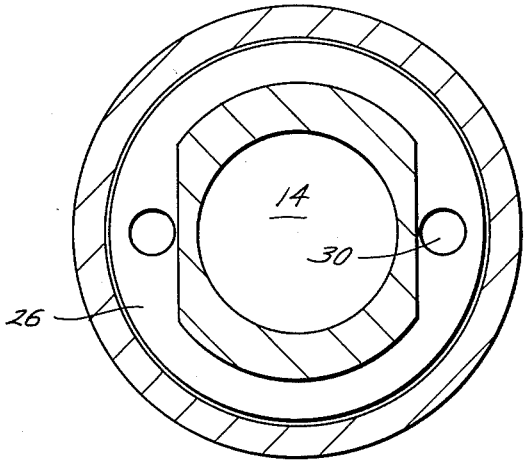
FIG. 3 is a cross-sectional view taken along the line 3—3 of FIG. 2B.

While the present improvements in a well valve will be shown, for purposes of illustration only, as incorporated in one type of safety valve and one type of gas lift valve, it is understood that the present invention may be used with other types of well valves.

Referring now to the drawings, particularly to FIGS. 1-4, a subsurface safety valve of the tubing retrievable type utilizing the present invention is generally indicated by the reference numeral 10, shown positioned in a well tubing 11, for permitting well production through the valve 10 under normal operating conditions, but in which the valve 10 may be closed when desired by actuation of hydraulic pressure through a control line 13 extending to the well surface.

The safety valve 10 generally includes a bore 14 an annular valve seat 16 positioned about the bore 14, a valve closure member such as flapper valve 18 connected to a housing 12 by a pivot pin 20. When the flapper 18 is in the upper position and seated on the valve seat 16, the safety valve 10 is closed, blocking flow upwardly through the bore 14 and the well tubing 11. A sliding tube or tubular member 22 is telescopically movable in the housing 12 and through the valve seat 16. As best seen in FIG. 2D, when the tubular member 22 is moved to a downward position, the tube 22 pushes the flapper 18 away from the valve seat 16. Thus, the valve 10 is held in the open position so long as the sliding tube 22 is in the downward position. When the sliding tube 22 is moved upwardly, the flapper 18 is allowed to move upwardly onto the seat 16 by the action of a spring 24 and also by the action of fluid flow moving upwardly through the bore 14 of the housing 12.

The safety valve 10 is controlled by the application or removal of hydraulic fluid through the control line 13 which supplies hydraulic fluid through a passageway 26 and to the top of one or more pistons 30 which in turn engage the tubular member 22 to move the member 22 downwardly forcing the flapper 18 off of the seat 16 and into the full open position. A biasing spring 36 acts between a movable shoulder means 28, which will be more fully discussed hereinafter, and a shoulder 32 for yieldably urging the tubular member 22 in an upward direction to release the flapper 18 for closing the valve 10. If the fluid pressure in the line 13 is reduced sufficiently relative to the biasing force of the spring 36 the tubular member 22 will move upwardly closing the valve 10. However, it is to be noted that the safety valve 10 will be positioned downhole in a well and the control line 13 and hydraulic passageway 26 will be filled with a hydraulic fluid which exerts a downward hydrostatic force on the pistons 30 in the valve at all times regardless of whether control pressure is exerted on or removed from the control line 13. This means that the upward force of the biasing spring 36 must be sufficient to overcome the hydrostatic pressure force existing in the control line 13 as well as provide a closure force to move the tubular member 22 upwardly less the force exerted on the pistons 30 by the well fluid in the tubing 11. Therefore, it is apparent that the biasing or closing force exerted by the spring 36 will vary depending upon the depth and operating conditions that the valve 10 encounters in the well, and affects the opening and closing pressures exerted in the control line 13 which in turn should not exceed the rated pressure of the tree (not shown) at the top of the well.

A conventional safety valve is assembled and set at the factory to be used under the operating conditions specified for a particular situation. In the event that the conditions change or the valve is to be used under different operating parameters, the valve is sent to the factory, partially disassembled, and a spring having a different closing force is substituted. The present invention is directed to providing a structure which will allow the external adjustment of the actuating force of the spring 36 for quickly and easily changing the opening and closing pressures of the valve 10 for suitably controlling the surface operating pressures.

Figure 4:
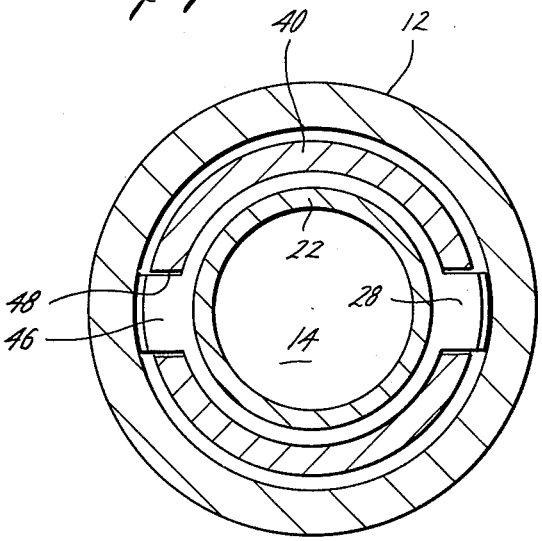
FIG. 4 is a cross-sectional view taken along the line 4—4 of FIG. 2C, and FIGS. 5A and 5B are continuations of each other of an elevational view, partly in cross section of a gas lift valve utilizing the present invention.
Figure 2A:
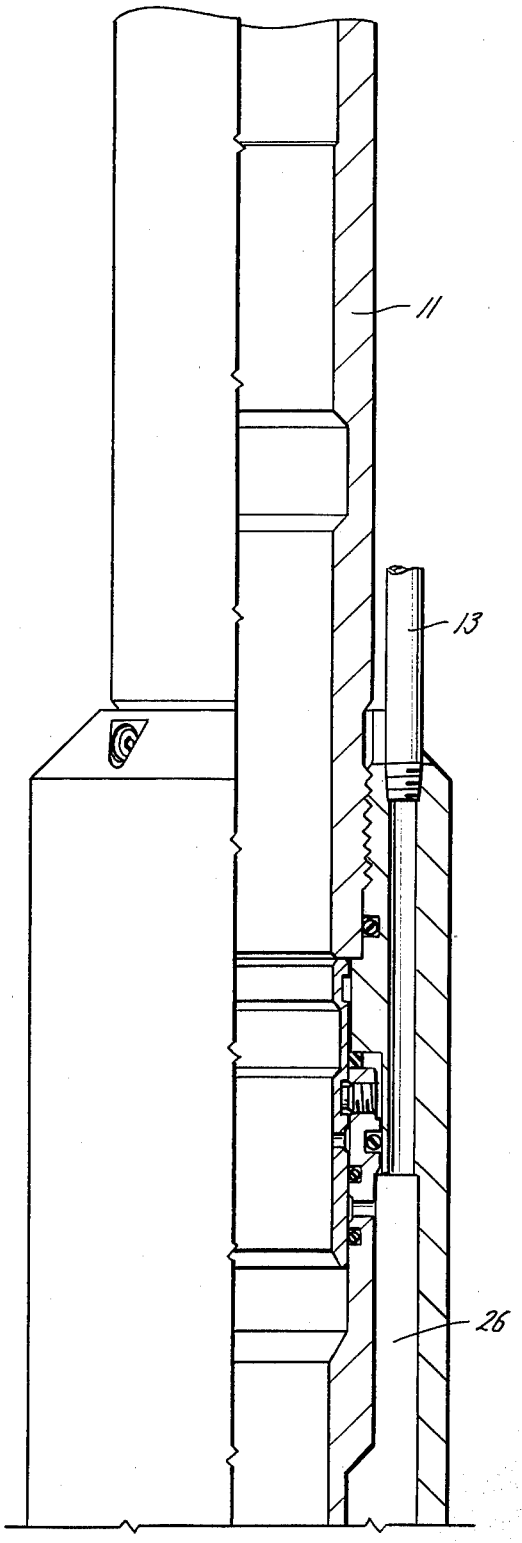
FIGS. 2A, 2B, 2C and 2D are continuations of each other of an enlarged elevational view, partly in cross section of a well safety valve utilizing the present invention.
Figure 2B:
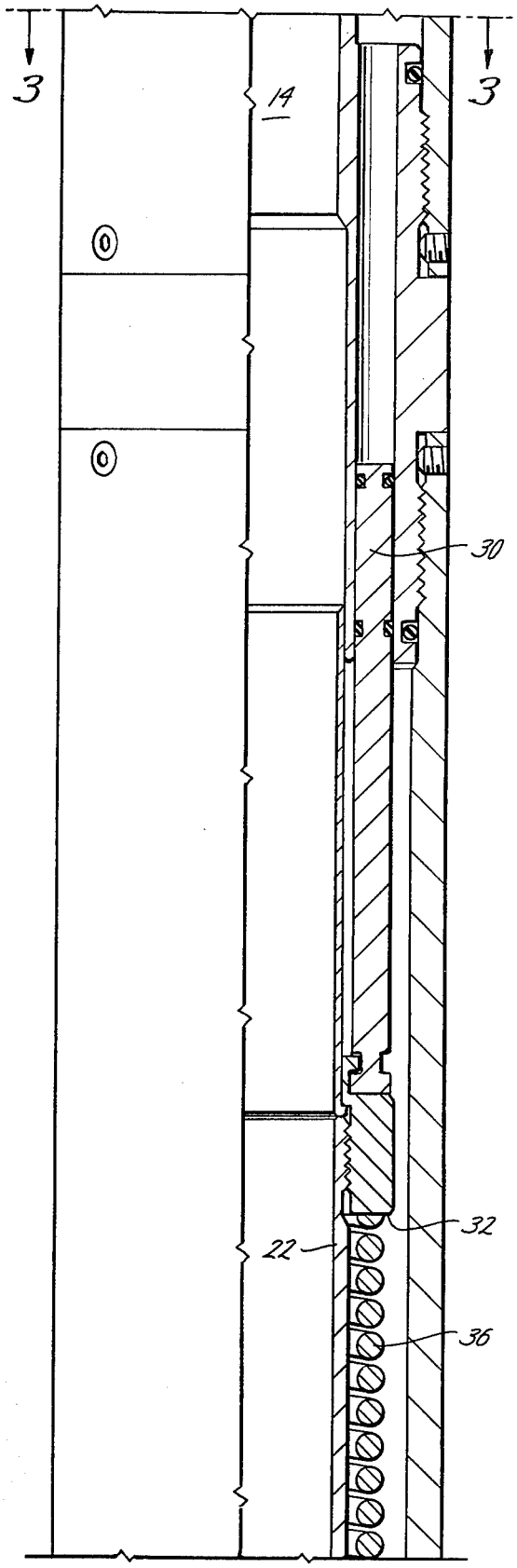
Figure 2C:
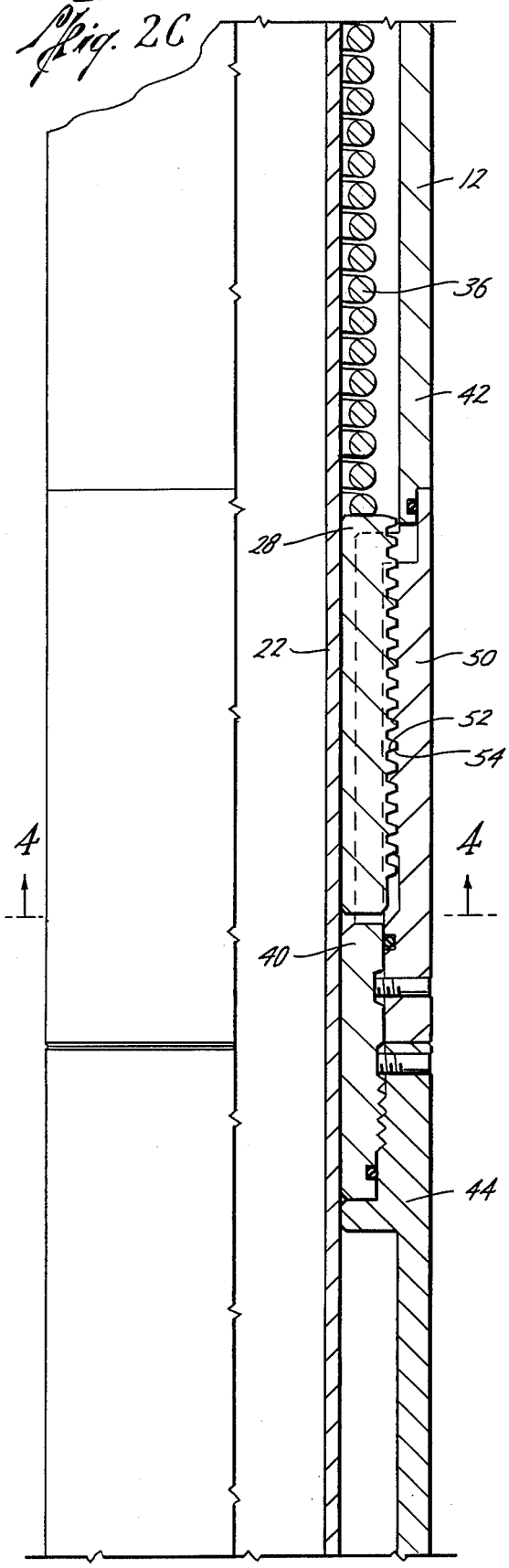
Figure 2D:
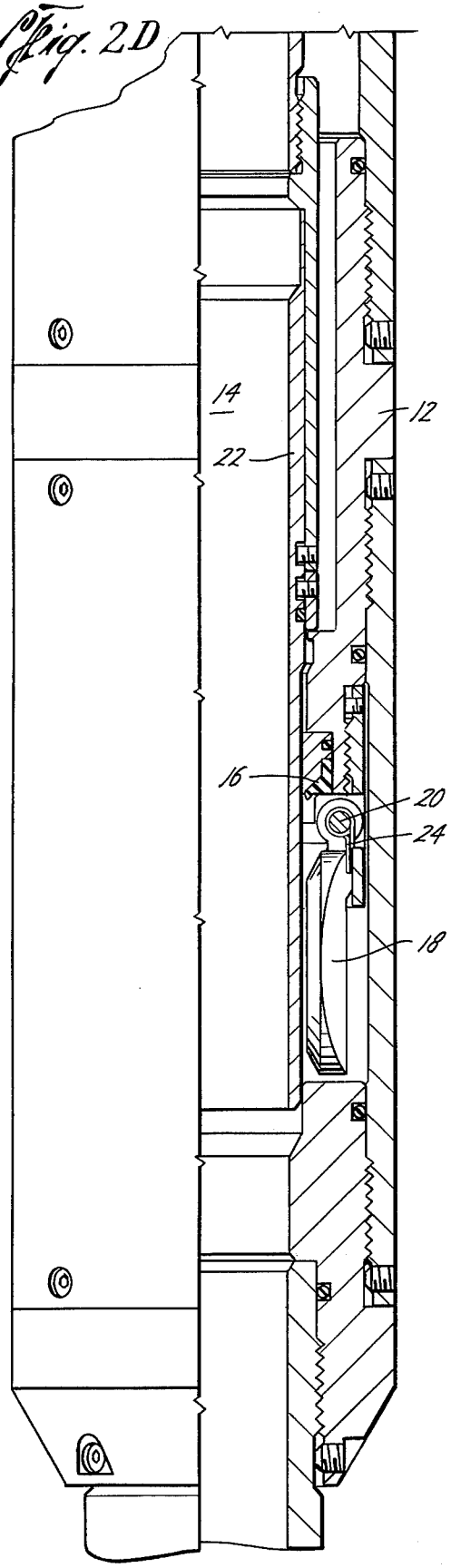

Referring now to FIGS. 2C and 4, the housing 12 includes a recess portion 40 interconnecting upper housing portion 42 and lower housing portion 44, which are exterior portions. The movable shoulder means 28 is longitudinally movable in the housing 12 but is nonrotatably movable relative to the housing 12 by coacting ear 46 and groove 48 connections between shoulder means 28 and housing portion 40. An adjusting means such as sleeve 50 is rotatably supported from the housing 12, but is longitudinally fixed relative to the housing 12 between housing portions 42 and 44, and is exposed to the exterior of the housing for externally rotating the adjusting sleeve 50. The adjusting sleeve 50 engages the movable shoulder 28 such as by coacting threads 52 and 54. Therefore, the adjusting sleeve 50 may be externally rotated for moving the shoulder 28 towards or away from the spring 36 thereby varying the closing force of the spring 36. Furthermore, if desired, coacting indicating lines 56 and 58 may be provided on the exterior of the housing 12 and adjusting sleeve 50, as best seen in FIG. 1, for providing a visual indication of the extent of adjustment, which in turn can be calibrated to indicate the change in the closing force of the spring 36.

Figure 5A:
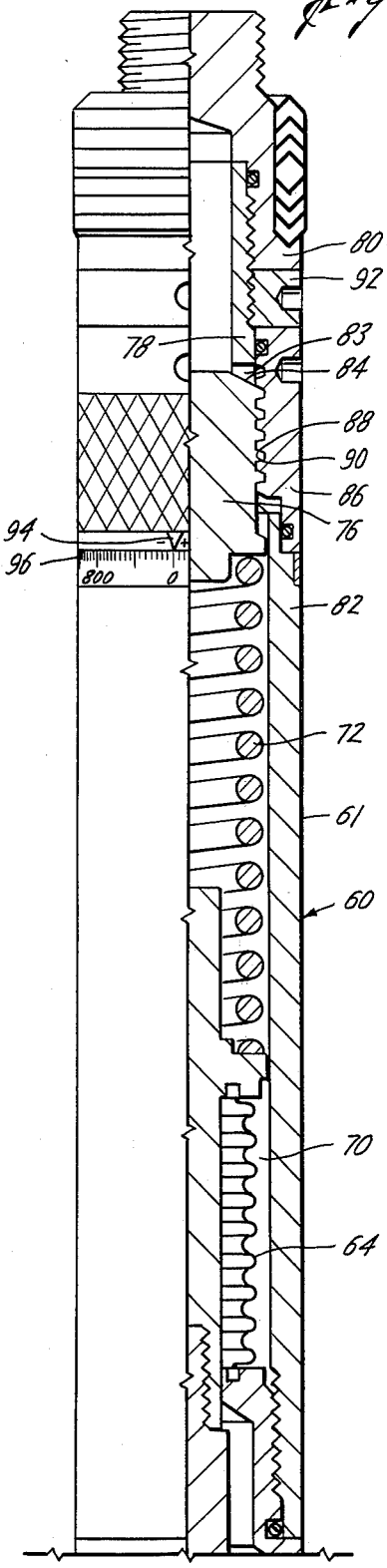
Figure 5B:
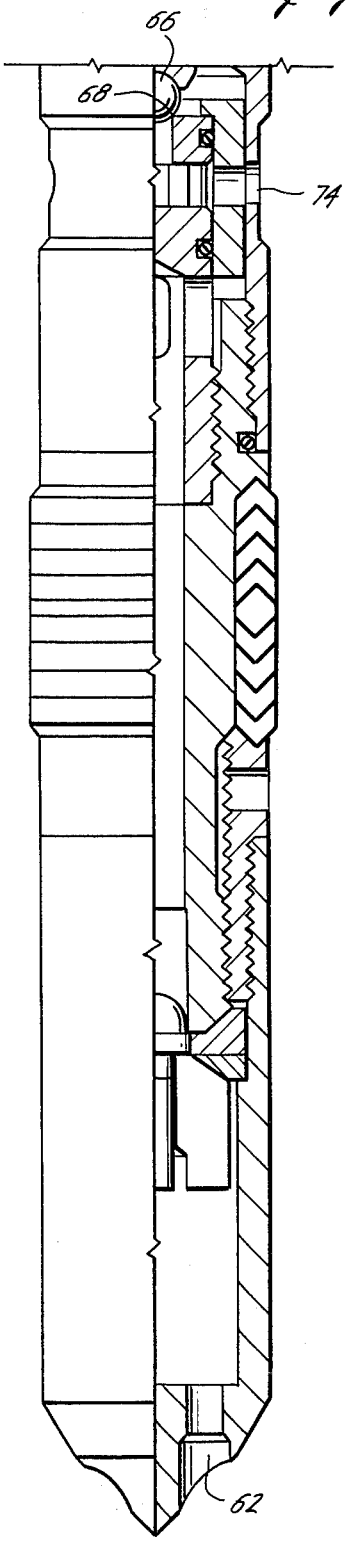

Referring now to FIGS. 5A and 5B, the use of the present invention in a gas lift valve is shown. The valve, generally indicated by the reference numeral 60, for purposes of illustration only, is shown as a Camco gas lift valve type BKF-6 which is adapted to be installed in a conventional Camco K series sidepocket mandrel in a tubing by means of a Camco BK series type latch. In this type of gas lift valve, gas is injected down the tubing and enters through openings 62 through the bottom of the valve and to the inside of the bellows 64. Normally, the valve element 66 is seated on the seat 68 and is urged to the closed position by the atmospheric pressure in chamber 70 acting on the outside of the bellows 64 as well as the force of the spring 72. When the gas pressure in the tubing is sufficient to overcome the closing force of the bellows 64 and spring 62, the valve is opened and gas flows through the open seat 68 and through ports 74 to produce fluid through an annulus between the tubing and a well casing as is conventional.

One end of the spring 72 acts against the bellows 64 and the second end acts against a shoulder means 76 which is longitudinally movable in the housing 61, but is nonrotatably movable relative to the housing 61. The housing 61 includes a portion 78 interconnecting upper housing portion 80 and lower housing portion 82. The shoulder means 76 coacts with the housing portion 78 by coacting groove and ear connections 83 and 84 for allowing longitudinal movement of the shoulder means 76 relative to the housing portion 78, but prevents rotation therebetween. Adjusting means such as adjusting sleeve 86 is provided rotatably connected but longitudinally fixed relative to the housing 61 between housing portions 80 and 82 and is exposed to the exterior of the housing 61 whereby the adjusting means 86 may be rotated. Coacting threads 88 and 90 between the shoulder means 76 and sleeve 86 are provided for moving the shoulder means 76 towards and away from the spring 72 by externally rotating the adjusting means 86 thereby varying the closing force of the spring 72 and thereby adjusting the closing and opening forces of the valve. If desired, a lock ring 92 may be provided which is threadably connected to the housing portion 78 for locking and unlocking the adjusting sleeve 86 relative to housing portion 78.

In addition, as shown on FIG. 5A, suitable indicia 94 and 96 of the extent of rotation of the adjusting sleeve 86 relative to housing portion 82 may be provided which can be calibrated thereby allowing the safety valve 60 to be quickly and easily adjusted in the field to make changes in the operational characteristics of the valve 60.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will readily suggest themselves to those skilled in the art and which are encompassed within the spirit of the invention and the scope of the appended claims.

What is claimed is:

1. In a valve for controlling fluid flow through a well tubing, the valve adapted to be positioned in the well tubing and having a housing and a valve closure member therein movable between open and closed positions, means for moving the valve member in a direction to open the valve, spring means acting against the opening force for moving the valve to the closed position, the improvement of means of externally adjusting the spring closing force comprising, shoulder means in the housing abutting the spring means, adjusting means engaging in said shoulder means and extending outside of the housing for moving said shoulder means toward and away from the spring means for varying the closing force of the spring means, and said adjusting means is rotatably connected but longitudinally fixed relative to the housing.

2. In a well safety valve for controlling the fluid flow through a well tubing, the valve adapted to be positioned in the well tubing and having a housing and a valve closure member therein movable between open and closed positions, a longitudinally movable tubular member for controlling the movement of the valve closure member, hydraulic means for moving the tubular member in a direction to open the valve, spring means for moving the tubular member in a direction to close the valve, the improvement of means for adjusting the valve closing force comprising, shoulder means abutting the spring means, adjusting means engaging said shoulder means and extending outside of the housing for moving said shoulder means toward and away from the spring means for varying the closing force of the spring means, and said adjusting means is rotatably connected but longitudinally fixed relative to the housing.

3. In a well safety valve for controlling the fluid flow through a well tubing, the valve adapted to be positioned in the well tubing and having a housing and a valve closure member therein movable between open and closed positions, a longitudinally movable tubular member for controlling the movement of the valve closure member, hydraulic means for moving the tubular member in a direction to open the valve, spring means for moving the tubular member in a direction to close the valve, the improvement of means for adjusting the valve closing force comprising, shoulder means longitudinally movable in the housing but non-rotatably movable relative to the housing, said shoulder means abutting the spring means, adjusting means rotatably connected but longitudinally fixed relative to the housing and exposed to the exterior of the housing for externally rotating the adjusting means, and coacting thread means between the shoulder means and the adjusting means for moving the shoulder means toward and away from the spring means by externally rotating the adjusting means thereby varying the closing force of the spring means.

* * * * *